US005740851A

United States Patent [19]

Haynes

[11] Patent Number: 5,740,851

[45] Date of Patent: Apr. 21, 1998

[54] COMPONENT WITH CAST-IN FLUID PASSAGEWAYS

[75] Inventor: Ronald L. Haynes, Searcy, Ark.

[73] Assignee: Trinova Corporation, Maumee, Ohio

[21] Appl. No.: 792,369

[22] Filed: Feb. 3, 1997

Related U.S. Application Data

[62] Division of Ser. No. 492,368, Jun. 19, 1995, abandoned.

[51] Int. Cl.[6] ..... B22D 19/00

[52] U.S. Cl. ..... 164/98

[58] Field of Search ..... 164/98; 29/888.02, 29/888.45, 888.453, 888.46; 285/150; 138/143

[56] References Cited

U.S. PATENT DOCUMENTS

| | | | |
|---|---|---|---|
| 3,584,655 | 6/1971 | Frank . | |
| 3,610,290 | 10/1971 | Anderson . | |
| 3,656,917 | 4/1972 | Kirland . | |
| 3,775,194 | 11/1973 | Dromsky . | |
| 4,669,529 | 6/1987 | Evertz . | |
| 4,738,159 | 4/1988 | Kato et al. . | |
| 4,740,018 | 4/1988 | Kenmount . | |
| 4,829,642 | 5/1989 | Thomas et al. . | |
| 4,832,106 | 5/1989 | Bucking et al. . | |
| 4,969,263 | 11/1990 | Adams | 164/98 |
| 5,111,872 | 5/1992 | Diehl et al. . | |
| 5,129,444 | 7/1992 | Bafford . | |
| 5,297,587 | 3/1994 | Johnson | 138/143 |

FOREIGN PATENT DOCUMENTS

| | | |
|---|---|---|
| 2379340 | 9/1978 | France . |
| 55-73455 | 6/1980 | Japan . |
| 59-144553 | 8/1984 | Japan . |
| 2073633 | 10/1981 | United Kingdom . |

*Primary Examiner*—Joseph J. Hail, III
*Assistant Examiner*—L-H. Lin
*Attorney, Agent, or Firm*—Jones, Day, Reavis & Pogue

[57] ABSTRACT

An invention is disclosed in which a mechanical hydraulic component includes fluid-bearing passageways. The fluid-bearing passageways are defined by a pre-formed tubing cluster which resides within a block which is cast around the tubing cluster in order to define a solid body which is fuse-bonded to the tubing cluster. The present mechanical body is formed by providing hollow tubing which is bent to provide a tube member having a desired configuration. A number of tube members are secured in order to provide a tubing cluster which defines the preformed fluid-bearing passageways. After that, a castable material is cast around the tubing cluster so as to produce a solid block with the tubing cluster embedded therein. The block and tubing cluster are formed of predetermined materials which result in chemical infiltration in order to produce a low-porosity fusion bond.

3 Claims, 3 Drawing Sheets

COMPONENT WITH CAST-IN FLUID PASSAGEWAYS

This is a divisional of application Ser. No. 08/492,368 filed on Jan. 19, 1995 and now abandoned.

BACKGROUND OF THE INVENTION

The present invention is directed to the field of cast metal parts, particularly parts which require non-linear passageways formed therein. The invention is particularly applicable to hydraulic components which use such non-linear passageways for the transmission of hydraulic fluid.

Hydraulic components such as valves and pumps are typically formed from a cast metal block with a network of fluid passageways used to transport fluid in order to apply hydraulic forces. Due to the requirements of hydraulic components, several of the fluid passageways are non-linear within the block. Such passageways are often required to have directional changes in order to direct the hydraulic forces in the manner required by the component.

In a typical previous process, as shown in FIG. 1A, such passageways are formed by conventional machining operations. A block 10 is bored out to include a plurality of linear bores 12, 14, 16. The bores 12, 14, 16 are positioned and drilled to a particular desired depth so as to intersect and create a fluid passageway 18 (See FIG. 1B). The fluid passageway extends from the first bore 12, through the second bore 14 and exiting the block 10 through the third bore 16. In order to define a continuous fluid passageway, the second bore 14 must be fluidly closed using a plug 20. To install the plug 20, the end of the second bore 14 must be tapped out and a suitable seat must be prepared for an O-ring or other type of fluid seal member. Thus, several machining steps are required for each fluid passageway 18. Since most hydraulic components use several such passageways, many machining steps are required in order to produce such a hydraulic component. As the number of machining operations contributes to the overall cost of manufacture, such hydraulic components are very expensive to produce.

The conventional machining operations create other problems. Occasionally, tools may break while boring holes, leaving the broken tool end inside the work. In this event, the part must be scrapped, regardless of the number of holes already bored, thus driving up overall costs. The plugs and seals used to seal off bored ends also contribute to the expense of manufacture, since as many as dozen or more plugs might be used in a complex part. Hydraulic components typically operate under very high fluid pressures, upwards of 3,000 psi (and above 5000 psi). Under such pressures, there is a chance of leakage from the plug site. With multiple plugs, the chances of leakage are increased. With conventional machining techniques, directional changes in a non-linear passageway must be effected by drilling intersecting bores. Pressure losses are significant across perpendicular bends in a fluid passageway. Thus, the passageways formed in previous systems are greatly inefficient at transmitting hydraulic pressure, and so more energy must be expended in the routine operation of such hydraulic systems.

Contamination is also a problem in machined hydraulic parts. Metal burrs can be produced at surfaces of the block 10 during machining operations. Such burrs pose a threat of contamination to machined hydraulic parts. The tolerances between moving parts within a hydraulic system are very tight, typically within a few ten-thousandths of an inch. Since burrs or other metal chips are much larger, they can jam between moving parts, thus hanging up their operations, possibly resulting in failure of the hydraulic system. Standard deburring operations are performed on machined hydraulic parts to insure against contamination. However, small burrs may be found at the intersections between bores. Such small burrs, if undetected, will work free after a time under hydraulic flow, causing operational failure.

SUMMARY OF THE INVENTION

In view of the disadvantages and drawbacks with the previous machined hydraulic components, there is therefore a need for a process for making a mechanical body with fluid-bearing passageways which reduces the number of machining steps.

There is also a need for a process for making a mechanical body with fluid-bearing passageways which reduces the risk of tool breakage.

There is also a need for a process for making a mechanical body with fluid-bearing passageways which reduces the risk of metal chip contamination.

There is a further need for a mechanical body with fluid-bearing passageways which reduces plug requirements and the number of potential leak sites.

There is a further need for a mechanical body with fluid-bearing passageways which reduce hydraulic pressure losses.

The above-indicated needs are satisfied by the present invention in which a mechanical body is disclosed which includes fluid-bearing passageways. The fluid-bearing passageways are formed by a pre-formed tubing cluster which resides within a block which is cast around the tubing cluster in order to define a solid body for supporting the tubing cluster.

The present mechanical body is formed by providing hollow tubing which is bent to provide a tube member having a desired configuration. One or more tube members are secured in order to provide a tubing cluster which defines the pre-formed fluid-bearing passageways. After that, a castable material is cast around the tubing cluster so as to produce a solid block with the tubing cluster embedded therein.

The above and other features and needs satisfied by the present invention will become apparent from consideration of the following detailed description of the invention which represents a preferred embodiment of the invention as is particularly illustrated in the accompanying drawings.

DETAILED DESCRIPTION OF THE INVENTION

Figure 1A:
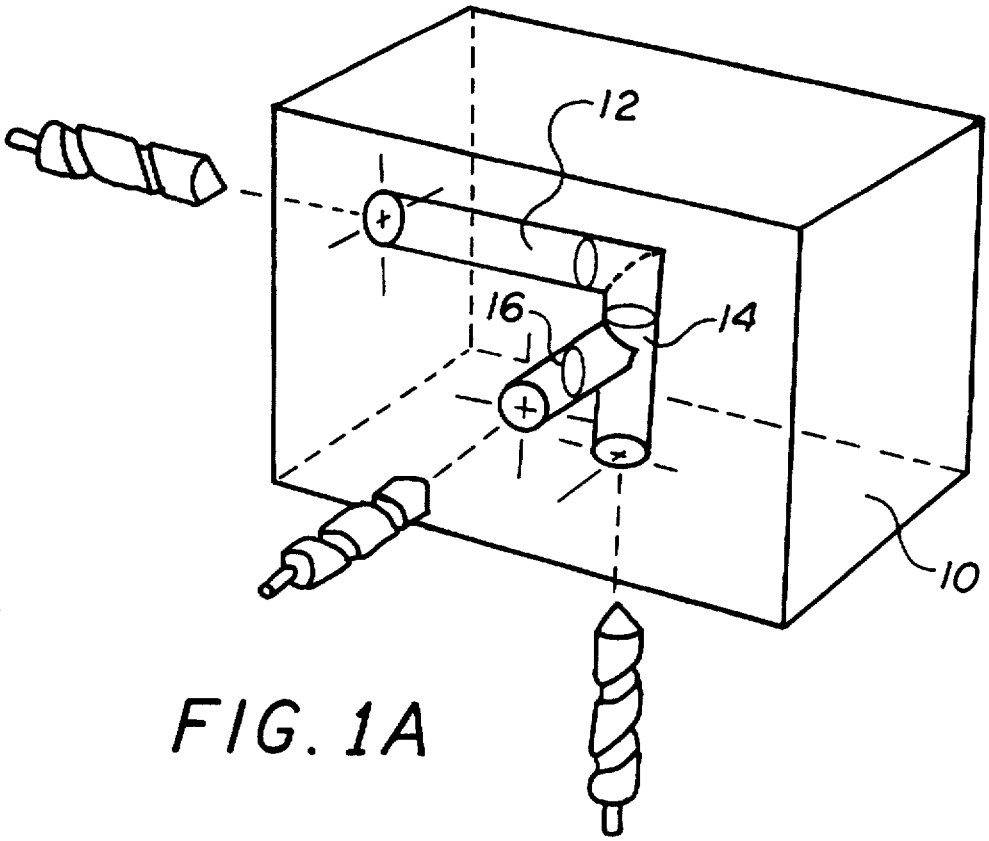
FIGS. 1*a* and 1*b* are oblique views illustrating the steps used to create fluid passages in previous systems.
Figure 1B:
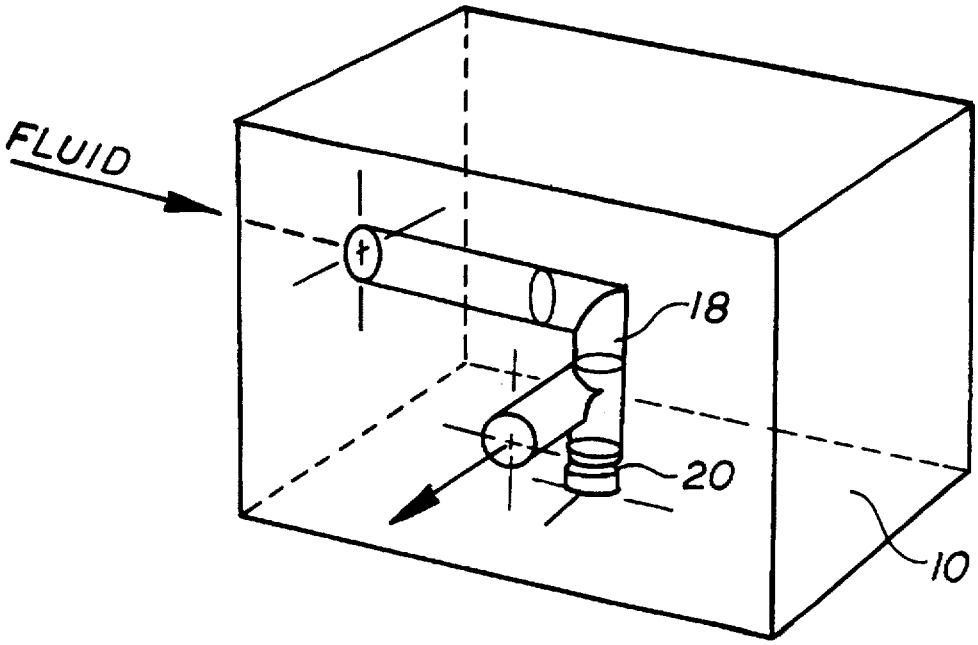
Figure 2:
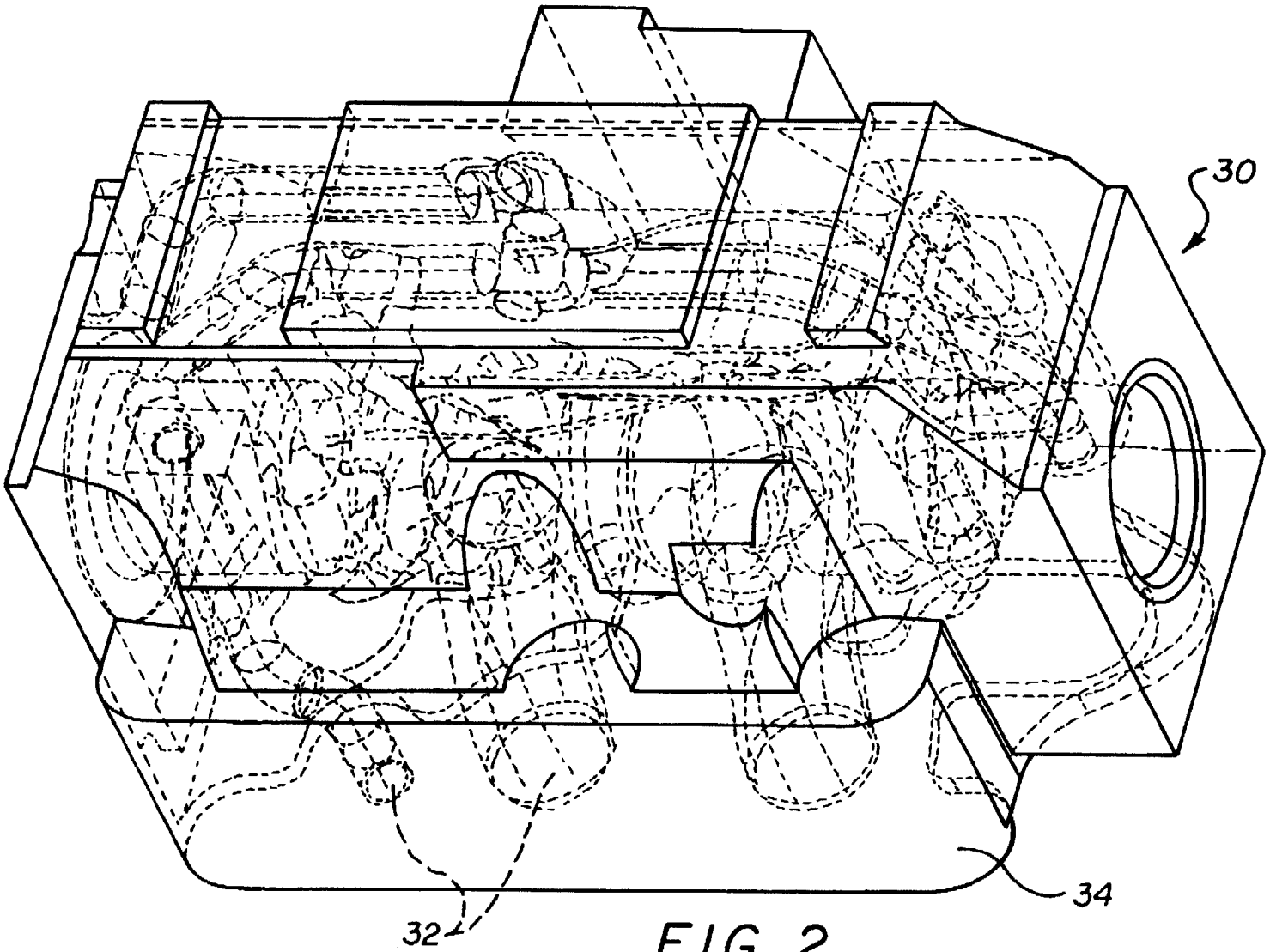
FIG. 2 is an oblique view depicting an hydraulic component having fluid passageways formed in accordance with the present invention.

The present invention has particular applicability to hydraulic components which require a complex network of non-linear fluid passageways in order to distribute hydraulic forces in a required manner. FIG. 2 depicts a hydraulic directional control valve 30 made in accordance with the present invention. This type of hydraulic component has a particularly intricate network of fluid passageways 32 formed within the block 34 of the component. Of course, it will be appreciated that other components can be formed, having a network of passageways with greater and lesser complexity, without departing from the present invention.

The present invention produces such non-linear passageways without performing conventional boring operations.

Figure 3:
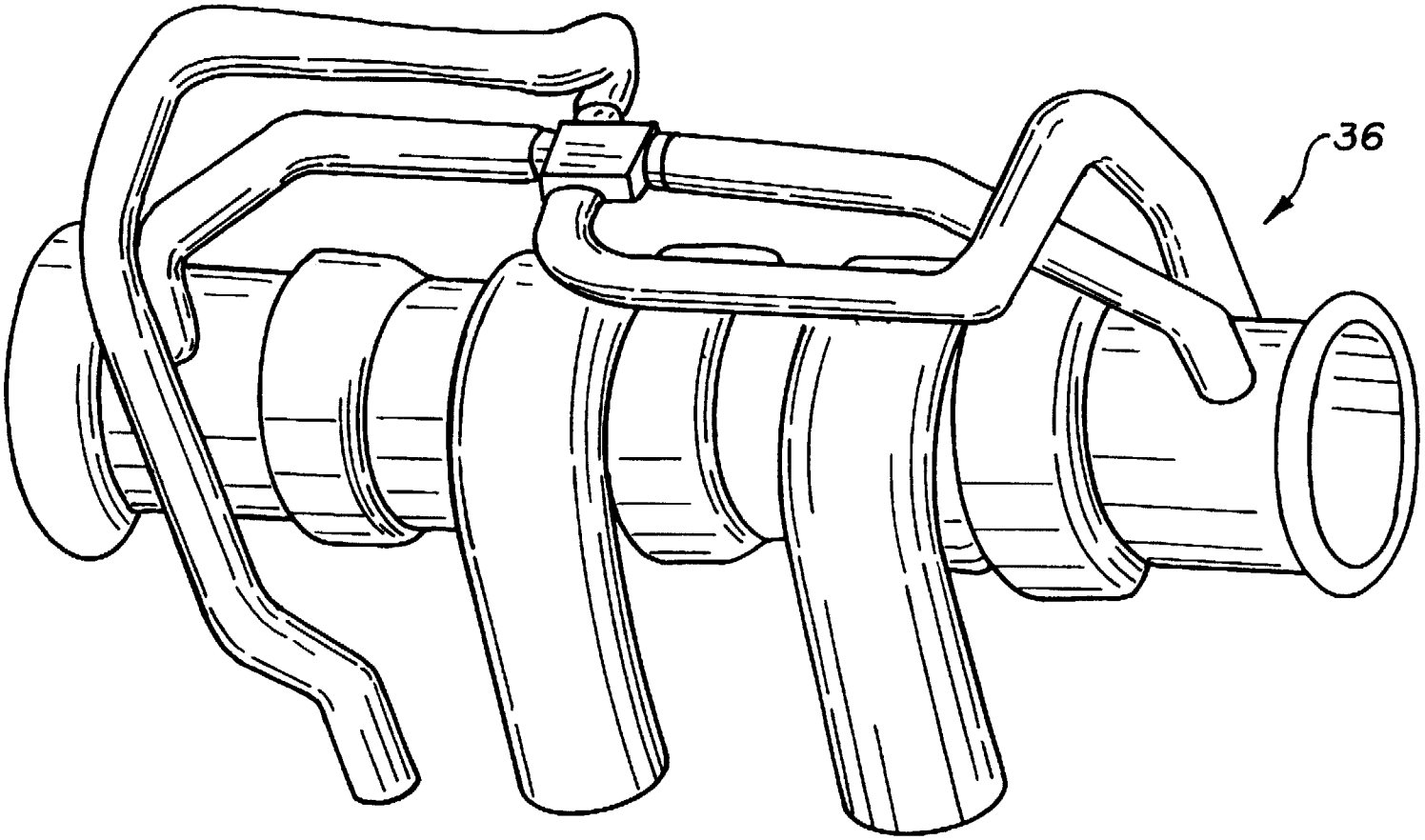
FIG. 3 is an oblique view showing the tubing cluster in accordance with the present invention.

As seen in FIG. 3, the fluid passageways 32 are defined by fashioning a pre-formed tubing cluster 36 made from hollow tubing. The tubing cluster 36 is placed into a mold where a castable material (preferably iron) is cast around the tubing cluster 36 in order to define a solid body of considerable mechanical strength, able to withstand hydraulic pressures upwards of 3,000 psi (and above 5000 psi).

The component of the present invention is made by a novel method. Tubing is provided having the necessary inner diameter. More than one tubing stock may be used, having more than one inner diameter, depending on the requirements of the final product. The tubing is then bent to the proper angles along the required lengths in order to fashion the required passageway configuration. In the preferred embodiment, the tubing is bent using a computer numeric control (CNC) driven machine. However, the tubing can be bent using any known technique without departing from the invention.

The bent tubing is then secured to a core or other reference element in order to hold the tubing in the precise alignment required for the end points of the fluid passageways 32. The tubing pieces can be spot welded to insure the stability of the appropriate configuration of the tubing. The tubing may also be held in place using "chaplets" or "saddles" such as are known in the art. The secured tubing configuration defines a "tubing cluster" 36. The tubing cluster 36 is then inserted into a mold into which a castable material is poured around the tubing cluster 36. In the preferred embodiment, the castable material is iron which is poured at a temperature of about 2,500° F. However, the castable material can also be another castable metal such as aluminum. Upon hardening the castable material forms a block 34 of sufficient mechanical strength to withstand the requirements of the component.

In the most basic form of the invention, the castable material is simply poured around the tubing cluster 36 and allowed to harden into a block 34. Such forms a strong mechanical bond which can withstand hydraulic pressures of up to approximately 5,000 psi without mechanical fatigue. However, the mechanical bond has a somewhat porous microstructure due to the material and thermal differentials between the ambient temperature tubing and the molten iron during casting. This porosity places limitations on the hydraulic pressures at which the component can be operated, thus limiting the applicability of the component.

Porosity is reduced in the present invention where the tubing cluster 36 is fusion bonded to the cast metal block 34. In order to accomplish the desired fusion bond, the tubing is fashioned so as to chemically bond with the block 34. In the preferred embodiment, the tubing is formed from a flat sheet in which a steel core is sandwiched between two layers of copper. The sheet is rolled over to form a cylindrical tube. It has been found that the sheet being turned over two times provides the tube with the desirable mechanical strength and other physical properties.

Upon casting, the copper on the outer layer of the tube fuse bonds with cast iron of the block. This is believed to result from an electrolytic reaction between the copper and the iron. A difference in electromotive potential exists between iron and copper metals. When these metals are brought into contact, it is believed that the difference in electromotive potential is equilibrated through a migration of copper particles into the matrix of the cast iron and vice versa. Due to this migration, porosity is reduced between the tubing cluster 36 and the block 34. In this way, a fusion bond is produced having superior mechanical strength. Besides the materials disclosed hereinabove, any materials could be selected which would produce the chemical infiltration necessary for a fusion bond.

Upon fusion, the passageways 32 defined by the tubing cluster 36 of the present invention become integral with the block 34. The strength of the passageways 32 is thus dependent on the wall thickness of the block 34, not the tubing 36. The component produced by the present process has fluid passageways 32 able to withstand significantly high pressures without mechanical failure. Thus, a hydraulic component made according to the present invention has passageways with a mechanical strength equal to those formed by previous machining processes.

The invention described hereinabove reduces the number of machining steps over that required for previous systems, thus reducing the costs of manufacture for such components. Scrapping due to tool breakage is reduced and incidents of leakage due to plug requirements are also reduced by the present invention. Further, the reduction in boring operations also reduces the possibility of equipment failure due to metal burr contamination. As fluid passageways are established with the present invention without boring, less castable material is used, also reducing the cost of manufacture.

The present fluid passageways have fewer sharp bends and turns in the passageways can be made with a longer radius of curvature. Also, the present fluid passageways can be shorter in length since a more direct path between endpoints can now be established. For these reasons, pressure losses within the fluid passageways can be greatly reduced. Thus, hydraulic components made according to the present invention are more efficient and have more available thrust and increased power. The present invention therefore reduces the limitations of previous systems, thus extending the applicability of hydraulic systems. As the full potential of this invention is realized, it is likely that heretofore uncontemplated hydraulic systems will be designed in order to exploit these advantages.

The foregoing description of the preferred embodiment has been presented for purposes of illustration and description. It is not intended to be limiting insofar as to exclude other modifications and variations such as would occur to those skilled in the art. Any modifications such as would occur to those skilled in the art in view of the above teachings are contemplated as being within the scope of the invention as defined by the appended claims.

I claim:

1. A method for forming a mechanical body which includes pre-formed fluid-bearing passageways, said method comprising the steps of:

providing a laminate sheet having steel and copper layers;

rolling the sheet to create hollow, cylindrical tubing, wherein the copper layer is on the tubing exterior;

bending the tubing to produce at least one tube member having a desired configuration;

securing said at least one tube member in order to provide a tubing cluster which defines said pre-formed fluid-bearing passageways;

casting iron around the tubing cluster in order to produce a solid block with the tubing cluster embedded therein, wherein the block and the tubing cluster form low-porosity fusion bond due to chemical migration of the copper into the iron matrix.

2. The method of claim 1 wherein during rolling, the sheet is turned over twice.

3. The method of claim 1 wherein the laminate includes a sheet of steel sandwiched between two copper sheets.

* * * * *